United States Patent [19]

Ikeda et al.

[11] 4,374,695

[45] Feb. 22, 1983

[54] TOPS FITTED WITH BASINS AND PROCESS FOR THEIR PRODUCTION

[75] Inventors: Eiji Ikeda; Tomohiro Adachi, both of Nagoya; Yoshihiro Ito, Seto; Ryozo Yamada, Aichi; Akio Taga, Inazawa; Shigeo Takashima, Aichi, all of Japan

[73] Assignee: Aica Kogyo Co., Ltd., Nagoya, Japan

[21] Appl. No.: 224,531

[22] PCT Filed: Apr. 7, 1980

[86] PCT No.: PCT/JP80/00063

§ 371 Date: Dec. 5, 1980

§ 102(e) Date: Dec. 5, 1980

[87] PCT Pub. No.: WO80/02170

PCT Pub. Date: Oct. 16, 1980

[30] Foreign Application Priority Data

| | | | |
|---|---|---|---|
| Apr. 6, 1979 | [JP] | Japan | 54-41221 |
| Apr. 6, 1979 | [JP] | Japan | 54-41222 |
| Apr. 6, 1979 | [JP] | Japan | 54-41223 |
| Apr. 6, 1979 | [JP] | Japan | 54-41224 |
| Apr. 6, 1979 | [JP] | Japan | 54-41225 |
| Apr. 6, 1979 | [JP] | Japan | 54-41226 |

[51] Int. Cl.[3] ..... E03C 1/33; B32B 31/00

[52] U.S. Cl. ..... 156/293; 4/619; 4/632; 156/92; 156/305; 312/228

[58] Field of Search ..... 156/92, 293, 305; 4/619, 631, 632, 635, 637, 643; 312/228

[56] References Cited

U.S. PATENT DOCUMENTS 2,080,573 5/1937 Madsen ..... 4/631

FOREIGN PATENT DOCUMENTS 2917144 8/1980 Fed. Rep. of Germany ..... 312/228
53-77760 7/1978 Japan ..... 156/305

*Primary Examiner*—Edward C. Kimlin
*Assistant Examiner*—F. K. Wine
*Attorney, Agent, or Firm*—Oblon, Fisher, Spivak, McClelland & Maier

[57] ABSTRACT

A top fitted with a basin having good water drainage which is constructed by fixing the basin to the top made by laminating a decorative board on the top surface of a wood derived material, e.g. plywood, particle board etc. as a core material, so that a flange part of the basin is situated beneath the rear surface of the decorative board, and bonding and reinforcing with a synthetic resin, and a process for their production.

By the present invention, the basin can be firmly fixed without any spaces, and therefore remarkably increases durability of kitchen fixtures.

8 Claims, 18 Drawing Figures

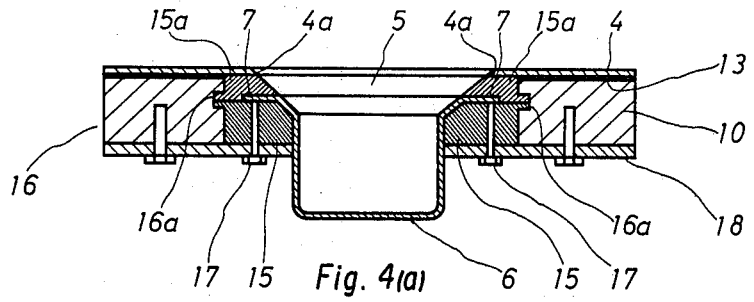
Fig. 4(a)
Fig. 4(b)
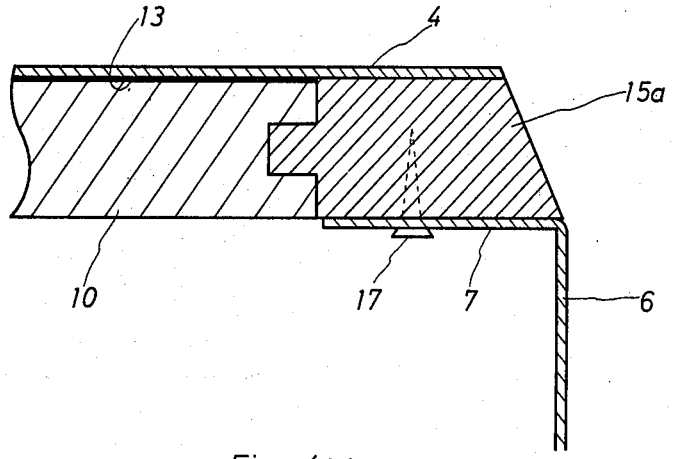
Fig. 4(c)
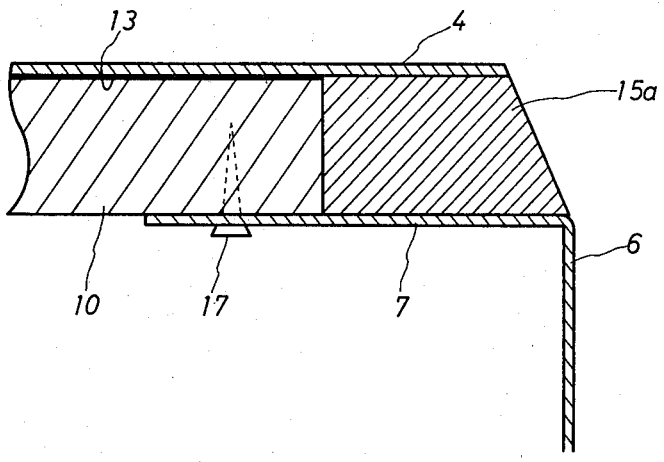

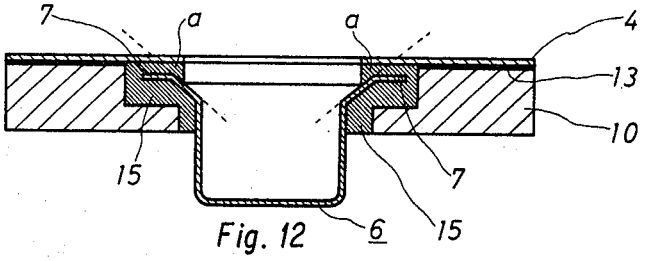
Fig. 12
Fig. 13
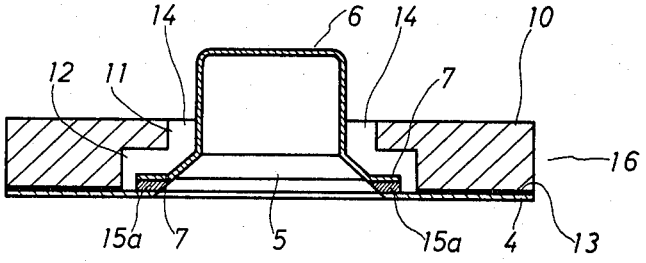
Fig. 14
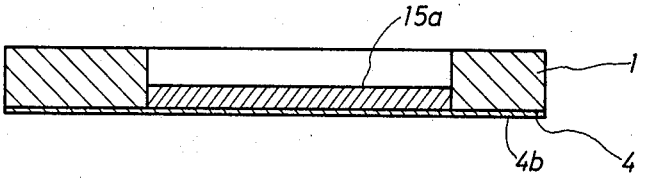
Fig. 15
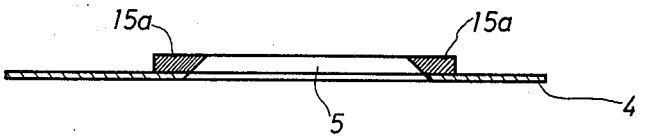
Fig. 16
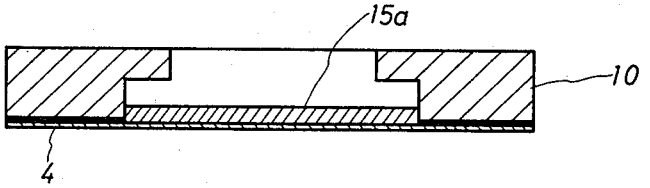

TOPS FITTED WITH BASINS AND PROCESS FOR THEIR PRODUCTION

TECHNICAL FIELD

The present invention relates to fixture tops fitted with basins for use in washing stands, kitchen sinks etc., and more particularly, it relates to tops fitted with basins having good water draining properties by being so constructed that water spilt on the surface of the top flows into the basin and a process for their production.

BACKGROUND ART

Lately with the development of the housing industry, the secondary housing industry has progressed very rapidly, including manufacture of built-in furniture, kitchen sinks, washing stands as unit equipment.

Kitchen sinks and washing stands are one of the interior fixtures essential for every day life, and a variety of such products directed to the taste of customers are being presented on the market.

Since kitchen sinks and washing stands are fixtures which inevitably involve use of water, a top which supports a basin is provided horizontally as one of the constituent members. As such a top there is usually employed that having a structure obtained by making the surface of a wood derived core material repellent to water and at the same time giving a color so as to serve also as surface decoration or bonding a melamine decorative board having a woodgrain pattern. The kitchen sinks and washing stands are, as described above, fixtures utilizing water indoors, and therefore the used water should not leak into other areas than the sinks and washing stands.

Accordingly, various devices have been imparted to the aforementioned tops fitted with basins in order to prevent leakage of water spilt on the surface of the top through a joint part between a flange part of the basin and the edge of a hole in the top for imbedding the basin. One such example is a product in which a basin flange part is mounted on a top, the joint part thereof with the edge of a hole in the top for imbedding the basin is sealed by fixing a rubber packing or other sealing materials, and the top and the basin flange part are fixed together by screwing from the rear surface of the top. However, those having such a structure suffer from disadvantages that with prolonged use, the rubber packing or other sealing materials are degraded and allow spaces around the edge of the aforementioned imbedding hole to cause water leakage, thereby resulting in swelling and corrosion of the top itself, which then forms gaps between the surface of the top and the basin flange part, finally permitting water spilt on the top to drop onto the floor instead of flowing into the basin, thus making the neighborhood of the sink or washing stand very moist.

As an alternative to those having such structure that the joint part between the basin flange part and the edge of the hole in the top for imbedding a basin is sealed using a rubber packing or other sealing materials, there is a structure in which a hole in the top is made larger than the basin itself, and the top decorative board alone is provided with a hole having the same dimention as the open part of the basin, and the basin flange part is fitted and directly adhered to the hole edge of the decorative board on its rear surface using a synthetic resin. By being of such a structure, since the flange part of the basin is situated lower than the surface of the top, all the water spilt on the surface of the top flows into the basin, thus solving the aforementioned problem of drainage of water spilt on the surface of the top. However, with this structure, the strength of the bonded part between the top decorative board and the basin flange part is weak, and it therefore tends to be damaged during transport and the decorative board is also easily impaired. Moreover, the finish treatment of the synthetic resin used for adhering the joint part between the hole edge of the decorative board and the basin flange part is troublesome and requires a lot of labor and time, and therefore it is not applicable to manufacture of products having a structure suitable for mass production.

As mentioned above, in fabricating tops fitted with basins used in kitchen sinks, washing stands etc., various problems are present from a standpoint of working to prevent water leakage in the joint part between the basin flange part and the hole in the top for imbedding a basin.

The present invention aims to present tops fitted with basins which can provide good water drainage and have a structure permitting their mass production by eliminating problems involved in the structure and fabrication of tops fitted with basins which are constituent members for kitchen sinks and washing stands, as well as a process for their production.

DISCLOSURE OF THE INVENTION

The present invention resides in a top fitted with a basin to be used in kitchen sinks and washing stands, having a structure presenting good water drainage by situating the surface of a flange part of the basin at a position lower than the surface of the top in which it is imbedded, thereby allowing all the water spilt on the surface of the top flow into the basin, and further in which the joint between the basin flange part and the top is made strong, as well as a process for their production.

BRIEF DESCRIPTION OF THE DRAWING

FIGS. 1–4 show vertical cross sections of tops fitted with basins according to the present invention;

FIGS. 5–12 are illustrative diagrams showing the production principle of the basin shown in FIG. 1 as a representative; and FIGS. 13–16 are illustrative diagrams showing the production principle of a top fitted with a basin according to the present invention, all of which are given in vertical cross sections.

BEST MODE OF CARRYING OUT THE INVENTION

Figure 1:
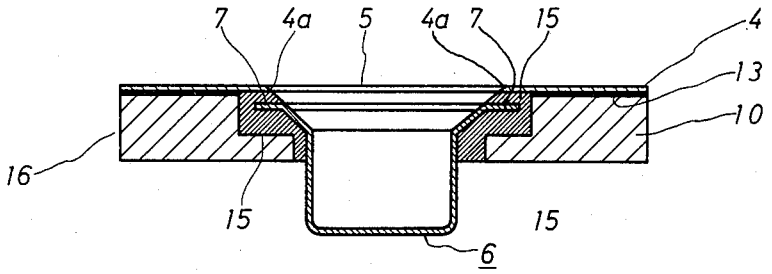

In FIGS. 1–4, (16) is a top and is composed of a wood derived core material (10) and a decorative board (4) laminated thereon with an adhesive (13).

In this top (16) is imbedded a metal basin (6). Herein, a flange part (7) of the basin (6) is situated close to the rear surface of a hole edge **(4*a*) of an open part (5) on the surface of the abovementioned decorative board (4) with a specific interval therebetween, and the interval part is filled with a thermosetting synthetic resin, such as a polyester type, rigid polyurethane type or epoxy type resin (15) to adhere with the wood derived core material (10) to give reinforcement. In other words, the flange part (7) is imbedded in the synthetic resin at a position lower than the surface of the decorative board (4)** and fixed therein, and therefore water spilt on the top can flow into a basin (6), thus preventing a poor drainage problem, which is an important feature of the present invention.

Figure 2:
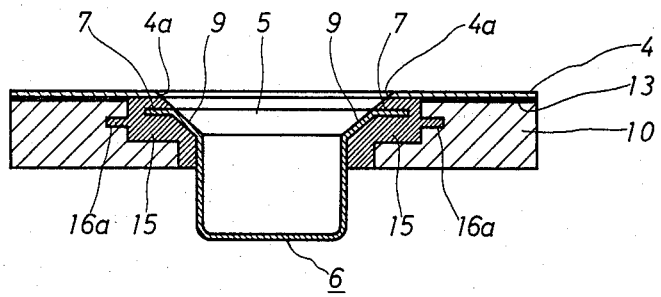
Figure 3:
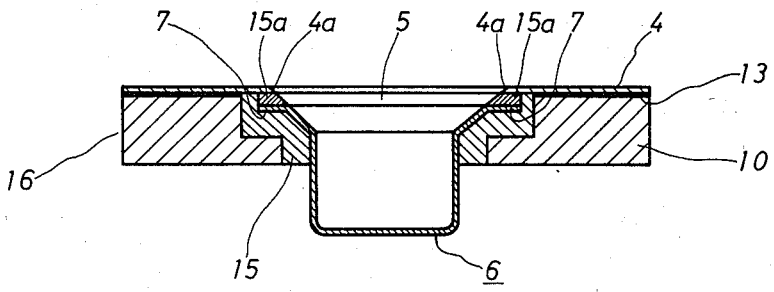

FIG. 2 shows a modification of the top fitted with a basin shown in FIG. 1, in which a channel (16*a*) is provided around the peripheral wall of the hole edge in the wood derived core material (10) and a synthetic resin is introduced also into this part and cured therein, thereby achieving further reinforcing effect by said resin. The top fitted with a basin shown in FIG. 3 is that in which a thermosetting synthetic resin has been poured into a cavity formed by the flange part (7) and the rear surface of the hole edge (4*a*) of the open part (5) of the decorative board (4) in the top fitted with a basin shown in FIG. 1 and cured to form a reinforcing resin layer (15*a*), then the basin is placed and the thermosetting synthetic resin (15) is poured, thereby imbedding and fixing the flange part (7). The top fitted with a basin shown in FIG. 4 (a) is of a structure in which, similar to that in FIG. 3, the thermosetting synthetic resin is poured into the cavity made along with the rear surface of the hole edge (4*a*) of the open part (5) of the decorative board (4) and cured to form the reinforcing resin layer (15*a*), then the flange part (7) is firmly fixed using a fixing means (17), the thermosetting synthetic resin (15) is again poured and a rear surface facing material (18) is bonded. In some cases, however, it is possible to use a structure which retains this cavity as such without pouring the thermosetting synthetic resin, although the result is somewhat poor in strength.

In addition, it is also possible to directly fix the flange part (7) to the rear surface of the reinforcing resin layer (15*a*) using the fixing means (17) as shown in FIG. 4 (b). Alternatively, as in FIG. 4 (c), it is possible to directly fix it to the rear surface of the core material (10) using the fixing means (17).

The process steps of producing a top fitted with a basin will now be explained using that having the structure shown in FIG. 1.

Figure 5:
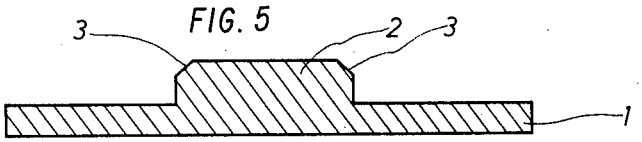

In FIG. 5, (1) is a wood or metal mold release frame constructed of a flat plate provided with a protruded part (2), the periphery of the top surface of which is made into the beveled part (3) corresponding to the open sloped surface of the basin (6). Further, the protruded part (2) has a dimention complementary to the hole (5) for imbedding a basin to be made in a decorative board (4) described hereinbelow which constitutes the top surface part of the top.

Figure 6:
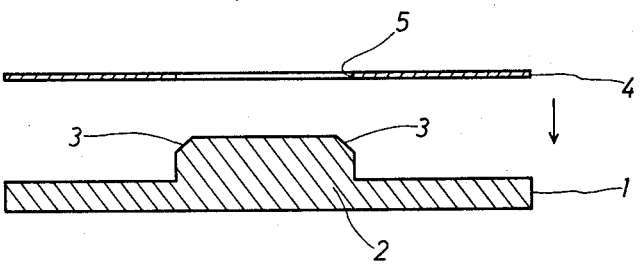
Figure 7:
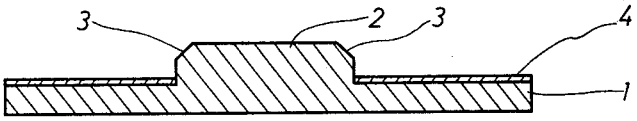

In the first place, the decorative board provided with the hole (5) for imbedding a basin shown in FIG. 6 is put on the abovementioned protruded part (2) as shown in FIG. 7, with the surface to be the top surface of the top facing down, and fixed in the mold release frame (1). In this case, it is essential that the hole (5) in the decorative board (4) for imbedding a basin have such a size that the flange part (7) provided at the upper edge of the basin (6) covers the hole edge.

Figure 8:
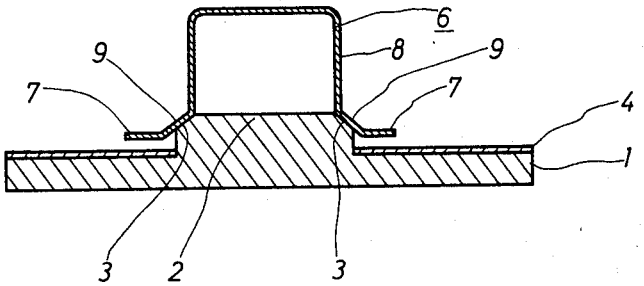

After the decorative board (4) is fixed in the mold release frame (1), a basin (6) consisting of the flange surface (7), a body (8) and a sloped surface (9) is mounted upside down on the protruded part (2) of the abovementioned mold release frame (1) as shown in FIG. 8. In this case, since the beveled part (3) of the protruded part (2) and the above-mentioned sloped surface (9) of the basin (7) fit right with each other, stable mounting is enabled, thereby a certain space is formed between the flange surface (7) and the decorative board (4).

Figure 9:
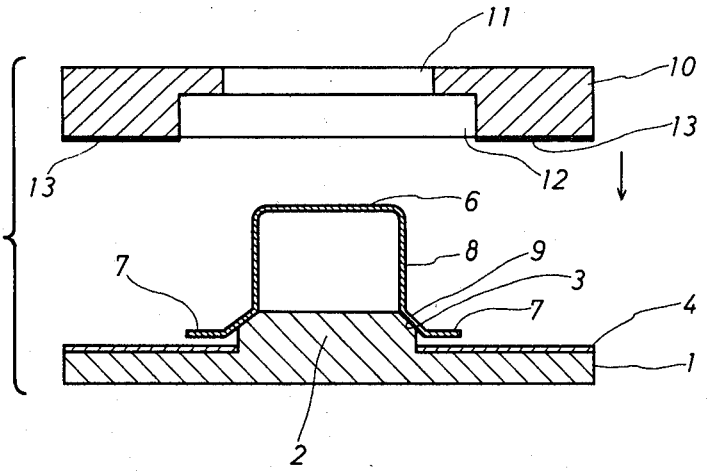
Figure 10:
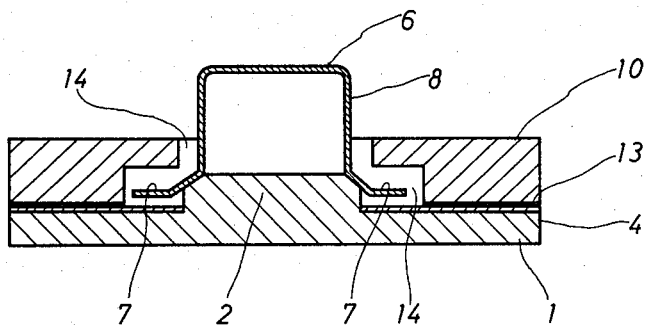

In the next place, the wood derived core material (10) to be the main part of the top is laminated on the abovementioned decorative board (4). This wood derived core material (10) is made of, for example, plywood, particle board etc., and as shown in FIG. 9, it is provided with holes (11) and (12) both having large sizes than the body (8) of the basin (6) with difference in dimention therebetween and the surface to be laminated with the abovementioned decorative board (4) is coated with the adhesive (13). This is inserted into the basin (6) as shown in FIG. 10 and pressed onto the decorative board (4).

By this, there is formed a cavity (14) defined by the body (8) of the basin, the wood derived core material (10) and the decorative board (4), and the flange surface (7) is then placed approximately in the center of said body (14).

Figure 11:
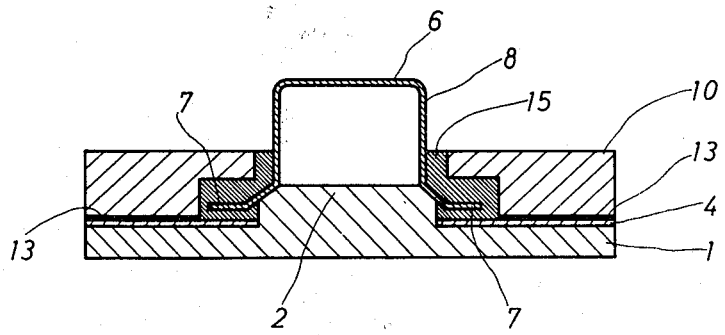

Next, as in FIG. 11, the thermosetting synthetic resin (15), e.g. a polyester resin, a polyurethane resin, an epoxy resin etc. is injected into the abovementioned cavity and cured so as to imbed the flange surface (7) in the resin layer, thereby fixing it as well as fixing it with the decorative board (4) and the wood derived core material (10).

After the flange surface (7) has been fixed as above, then as in FIG. 12, the mold release from (1) is removed, and the assembly is turned over, thereafter the extra part (a) consisting of a part of the decorative board around the open part of the basin and the cure resin is cut off along the broken line in the figure using, for example, a router, thereby the top fitted with a basin shown in FIG. 1 is completed.

FIG. 13 is an illustrative diagram showing the production principle of the top fitted with a basin shown in FIG. 3, in which the thermosetting resin is poured over the rear surface of the decorative board (4) to be brought into contact with the flange part (7) of the basin (6) and cured to form the reinforcing resin layer (15*a*) around the hole (5) in the decorative board (4) for imbedding a basin, thereafter the basin (6) is placed thereon with its bottom up and fixed so that its flange part (7) lies on the abovementioned reinforcing resin layer (15*a*), then the core material (10) having the holes (11) and (12) larger than the body of the basin (6) and difference in dimention is bonded onto the decorative board (4) using the adhesive (13), and the synthetic resin (15) is injected and filled into the cavity (14) formed by the core material (10) and the body of the basin (6), to fix the basin body.

The top fitted with a basin shown in FIG. 4 may also be fabricated by a similar principle, but in this case, it differs from that shown in FIG. 3 in that in injecting and filling the synthetic resin (15) the rear surface facing material (18) and the fixing means (17) are used to fix the flange part (7) more firmly.

In addition, FIG. 14 and FIG. 15 show an example of a method to form the reinforcing resin layer (15*a*) on the rear surface to be brought into contact with the flange part of the basin (6) in fabricating the tops fitted with basins shown in FIG. 3 and FIG. 4. More specifically, the surface (4*b*) of the decorative board (4) is turned down, the mold release frame (1) from which the central part has been removed is mounted thereon, and the synthetic resin (15*a*) is poured up to the predetermined height and allowed to cure, thereafter the frame (1) is removed. The reinforcing resin layer (15*a*) formed as in FIG. 15 and the decorative board (4) are integrated and by cutting along the sloped surface of the basin (6) using a tool such as a router there is provided the hole (5) for imbedding a basin.

Alternatively, as in FIG. 16, the decorative board (4) and the core material (10) may be bonded together without using the mold release frame (1), and the molten synthetic resin is poured into this assembly placed upside down and cured to form the reinforcing resin layer (15*a*), after which the hole (5) for imbedding a basin may be provided.

It is preferred to use a synthetic resin added with foaming agents, fibers, coloring agents etc. to make it a low foaming-setting type, since it is lightweight and excellent in strength, thus making cutting operation and nailing operation easy and rendering the finished resin surface colorful.

INDUSTRIAL APPLICABILITY

The top fitted with a basin obtained by the present invention has its basin flange part lower than the surface of the top, and therefore water spilt on the surface of the top can flow into the basin. Installation of such units provides kitchen sinks, washing stands etc. having good water drainage. Furthermore, since it has a structure in which a firm resin layer is formed between the basin flange surface and a wood derived core material which is the main material of the top, there is no such danger that a space is formed in the joint part between the basin flange part and the wood derived core material and causes water leakage or penetration of water into the decorative board or the core material. Still further, it has satisfactory strength and mass production of uniform quality products is enabled.

What is claimed is:

1. A fixture top fitted with a basin, said fixture top comprising:
- a core formed of a wood derived material;
- a decorative board bonded to the top surface of said core;
- a cavity formed in said core;
- a hole formed in said decorative board at a location concentric with said cavity, wherein said basin includes a flange positioned in said cavity at a location spaced below said decorative board and extending parallel to said decorative board;
- thermosetting synthetic fixing resin filling and reinforcing said cavity whereby said flange is entirely imbedded in said resin.

2. The fixture top of claim 1 wherein a portion of said resin positioned between said flange and said decorative board is provided with a sloped surface.

3. The fixture top fitted with a basin as set forth in claim 1 in which the cavity is filled and reinforced with the thermosetting synthetic resin in two layers with the flange surface therebetween whereby said flange surface is held by said two layers.

4. The fixture top fitted with a basin as set forth in claim 1 in which the thermosetting resin consists of one from the group consisting of a polyester type, rigid polyurethane type and epoxy type synthetic resin.

5. A process for producing a fixture top fitted with a basin, said process comprising the steps of:
- applying and curing a synthetic resin on a portion of the bottom surface of a decorative board so as to form a reinforcing resin layer;
- positioning a flange of said basin on said reinforcing resin layer and spaced from said decorative board;
- bonding a core of a wood derived material to another portion of said bottom surface of said decorative board, said core including a cavity at said layer and said basin;
- filling the portion of said cavity between said core and said basin with additional synthetic resin; and
- curing said additional resin,
- whereby said basin is entirely embedded in said resin and is integrated with said core.

6. A process for producing a fixture top fitted with a basin, said process comprising the steps of:
- bonding a portion of the bottom surface of a decorative board to the top surface of a core of a wood derived material, said core including a cavity;
- applying and curing a synthetic resin on another portion of said bottom surface of said decorative board so as to form a reinforcing resin layer;
- positioning a flange of said basin on said reinforcing resin layer and spaced from said decorative board;
- filling the portion of said cavity between said core and said basin with additional synthetic resin; and
- curing said additional resin,
- whereby said basin is entirely imbedded in said resin and is integrated with said core.

7. The process for producing a fixture top fitted with a basin as set forth in claim 6 in which the flange is brought into contact with said layer and fixed using a fixing means before the additional synthetic resin is poured.

8. The process of claims 5 or 6 including the step of providing said synthetic resin positioned between said decorative board and said flange with a sloped surface.

* * * * *